United States Patent [19]

Chaucer

[11] 4,275,374

[45] Jun. 23, 1981

[54] FUSE-PLUG ADAPTER FOR ELECTRICAL CORD

[76] Inventor: Daniel Chaucer, 84-61 Furmanvile Ave., Rego Park, N.Y. 11379

[21] Appl. No.: 67,933

[22] Filed: Aug. 20, 1979

[51] Int. Cl.[3] ..... H01H 85/02

[52] U.S. Cl. ..... 337/197; 337/198; 339/97 P; 339/99 R; 339/157 C

[58] Field of Search ..... 337/187, 197, 198, 201, 337/269; 339/97 R, 97 P, 99 R, 157 C

[56] References Cited

U.S. PATENT DOCUMENTS

| | | | |
|---|---|---|---|
| 1,974,700 | 9/1934 | Adams | 337/198 |
| 1,990,176 | 2/1935 | Fried | 337/197 |
| 2,644,056 | 6/1953 | Curtis | 337/198 |
| 2,676,223 | 4/1954 | Whitaker | 337/197 |
| 2,745,078 | 5/1956 | Wood | 339/157 C |
| 2,988,617 | 6/1961 | Graziosi | 337/197 |
| 3,218,413 | 11/1965 | Koch | 337/197 |
| 4,005,923 | 2/1977 | Davis | 339/157 C |
| 4,073,564 | 2/1978 | Davis | 339/157 C |

*Primary Examiner*—George Harris

[57] ABSTRACT

In a preferred embodiment, a string of Christmas lights includes a plug adapted to receive an electrical fuse within a lower insertion opening in the plug-face from which the male prong elements extend from the plug such that when the plug is withdrawn from a socket a fuse may be inserted or withdrawn, the insertion opening for the electrical fuse being continuous with a fuse-holding channel having at a far-end thereof a small opening too small for insertion or withdrawal of the fuse, through which small opening an object may be inserted to press-against a fuse within the channel in order to push the fuse out-of the lower insertion opening while maintaining the plug in an assembled state.

8 Claims, 6 Drawing Figures

FUSE-PLUG ADAPTER FOR ELECTRICAL CORD

This invention is directed to a novel safety feature for use with Christmas-tree lights, utilizing a fuse-plug as an integral part thereof.

BACKGROUND TO THE INVENTION

Prior art fuse-plugs have been of the adapter-type and have all required the disassemblying of the housing in order to remove a burned-out fuse, some requiring a replacement of the entire contact element serving as the male prong. Typical of these patents are U.S. Pat. No. 2,849,573 which has a fuse-portion integrally mounted non-removably between male and female elements for each prong. Also each element of the prongs of the U.S. Pat. No. 3,833,875 has its own separate fuse, each fuse being non-removable except by disassembling the entire housing. Likewise the fuses are non-removably enclosed, requiring a removal of a screw to disassemble the housing for the U.S. Pat. No. 3,497,850, and likewise for U.S. Pat. No. 3,184,569. None of the patents relate to features of replacement devoid of disassembling, nor with easily removable fuse-feature tempered with safety features. Likewise, none of these prior art patents relate to Christmas-tree lights which are notoreous in their inherent dangers of short-circuitry and tree fires involving short circuits.

SUMMARY OF THE INVENTION

Objects of the invention include the achieving of objects not a part of prior art patents, as well as having improved feature objects for adapters and plugs in general of which are directed to utilization of electrical fuses.

Another particular object is to obtain a Christmas-tree string of lights having a safety-fuse features as well as such feature being directed to a further object of safety in fuse-removal.

Another particular object, more broadly, is to obtain an adapter utilizable with any plug, to obtain improved safety in continued durability and utilization because of improved ease of fuse-replacement, together with safety features associated with the improved removal and replacement feature for the electrical fuse.

Another object is to obtain a fuse-plug or fuse-plug adapter having simple construction out of inexpensive units, making the advantages of the invention readily available within reasonable economic parameters of cost of production and eventual sales price.

Another object is to obtain a novel mechanism of removal from a plug or adapter, an electrical fuse mounted therein, and the embodiment of that mechanism within novel plugs and adapters.

Other objects become apparent from the preceding and following disclosure.

Objects of the invention are obtained by the embodiments described in the following figures, but are not limited to these particular embodiments which are intended to merely illustrate and improve understanding of the invention. Accordingly, preferred embodiments are illustrated herein.

Broadly the invention may be described as a housing structure having three separate channels, or channel-spaces in the sense of spaces for each of separate circuit leads in the nature of at lease a male prong element and possibly also a matching female socket element for each respective one of two of the channels. Also the term channel is used for a third channel in the sense of providing a third space having an insert opening in communication therewith through the casing or housing wall adapted for insertion and removal of electrical fuses therethrough; and also, an opening at the upper end of the third channel of a size too small to permit insertion or removal of an electrical fuse, but of sufficiently large size as to permit insertion of an object or element by which the fuse may be pushed-out-of the fuse-chamber space.

In a mere plug embodiment such as with the Christmas-tree string of lights, while the presence also of an adapter may be desirable for the pluggin-in of also other lights or plugs through the circuitry of this basic fuse-plug, there is no absolute requirement of female receptacles, the heart of the invention being the removability of the burned-out electrical fuse and ability to replace the same by an ordinary house-wife who is disinclined to have to dismantle a plug, and here merely easily pushes-out one fuse and inserts a replacement, a very simple procedure. Yet, such operation cannot be accomplished without pulling-out the Christmas-tree lights plug prior to either removal or attempted replacement, such being essential because the insertion-removal hole to the electrical fuse's housing-third chamber is located on the same face that has the prongs extending therefrom, such that the insert opening is not accessible until the plug is withdrawn from the socket into which it had previously been plugged. Thus, electrical prongs as male elements extend from the first and second bottom openings, and a third bottom opening is the electrical fuse-insertion opening. Mounted within the housing, in each channel for the first and second channel spaces, are circuitry-contacts through which electrical current is eventually fed-out to appropriate electrical resistances, such as the Christmas-tree light circuitry and lights thereof; that circuitry-contact in certain preferred embodiments is by way of a wire into which a toothed or serated or sharp edge cuts-into and through insulation and makes contact with the circuitry-wire conductor to thereby establish electrical conductivity and current flow therethrough. In other embodiments, the electrical contact may be a female element as a part of a female socket. In either event, for at least one of the first and second channels, the space for the female element or the otherwise electrical contact at the upper location of the channel space, communicates with the third channel space and the female element or other electrical contact in that upper space of the second channel space makes contact with a fuse's upper electrical contact when the fuse is within the fuse space of the third channel. Likewise, the male element or prong in that second channel space at the lower or bottom end thereof is also in contact with the fuse, with the fuse's lower-end contact through a communication space between the second and third channel spaces of the housing structure. The other prong or male element may also have a fuse, or alternately may otherwise have connections for conductivity between the male and female electrical elements, and in the illustrated preferred embodiment that first channel accomodates a single element which is continuous, as a male prong at one end thereof, and with the female structure at its upper end.

In the illustrated preferred embodiments, the invention relates to a fuse-adapter, preferably as a part of a Christmas-tree lights and circuitry combination. Into this adapter, other conventional light circuitry may be plugged to thereby also receive the benefit of the fuse-plug of the Christmas-tree unit.

In the preferred adapter embodiment, there is included a mechanism for clamping-in by simple and easy handling, the wire-ends of any circuitry, so that any electrical appliance or string of lights may be easily tied-into this adapter as a permanent arrangement as that illustrated for the Christmas-tree unit embodiment. The mechanism includes the mere removal of a casing lock-screw to remove the top, insert the two parted wires upwardly through a wire-insertion hole and separate the wires, laying one over one serated-edge of typically one female element or otherwise other electrical contact element, and the same for the other female element; and thereafter, upon replacing the removed-portion of the housing and screwing-it-down with the insertion and screwing of the screw, the serated edges cut-through the insulation and mount the wires to the fuse-plug. It should be noted that the serated edge-mounting of wiring per-se is not considered the invention, but the combination with the fuse-plug or fuse-plug adapter is considered a novel invention and major improvement and improved utility and advantage of the fuse adapter of this invention, together with other advantages.

The invention may be better understood by making reference to the following Figure descriptions.

THE FIGURES

DETAILED DESCRIPTION

Figure 5:
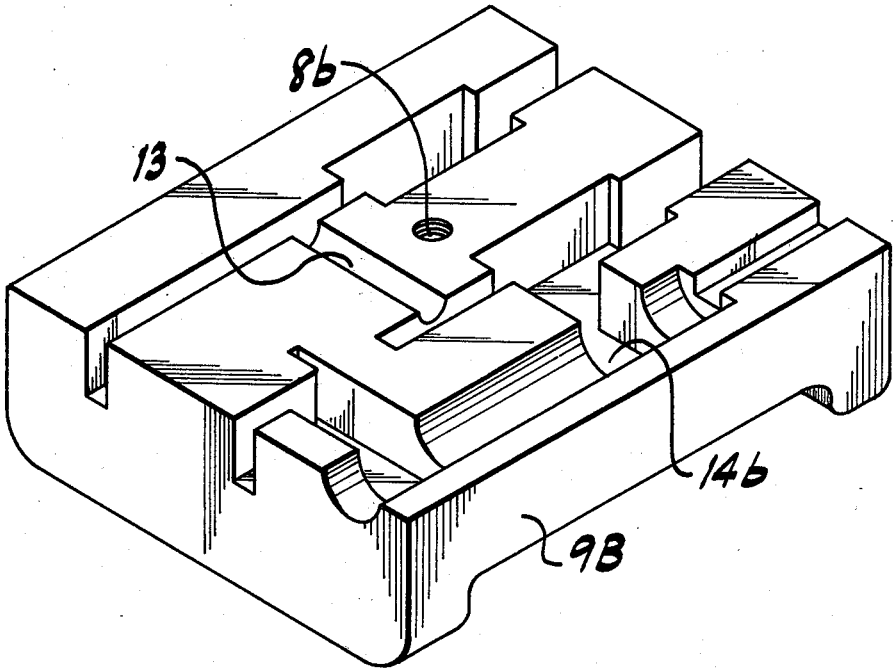
FIG. 5 illustrates a perspective top and end view, showing the inside face, of the remaining other half-shell of the housing structure of the embodiment of the preceding FIGS. 1 through 4.
Figure 6:
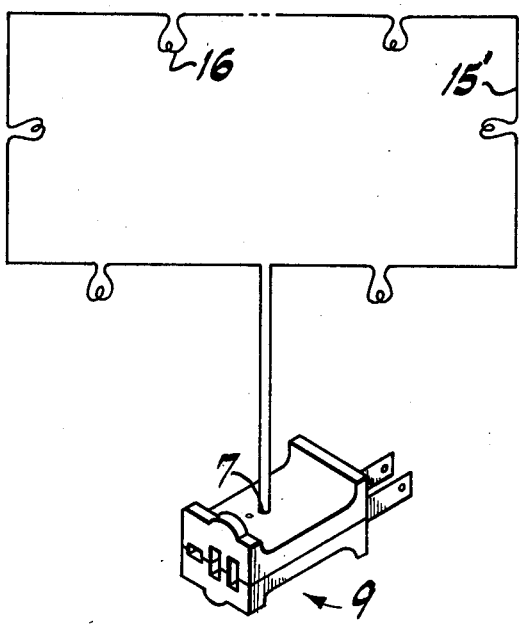
FIG. 6 illustrates the preferred Christmas-tree lights and circuitry embodiment diagrammatically and in perspective view.

FIGS. 1 through 6 all relate to a common preferred embodiment of electrical fuse-plug adapter, the FIG. 6 including also the greater combination inclusive of the entire unit 9 which has the wiring 15 and lights 16, etc. thereof.

Figure 1:
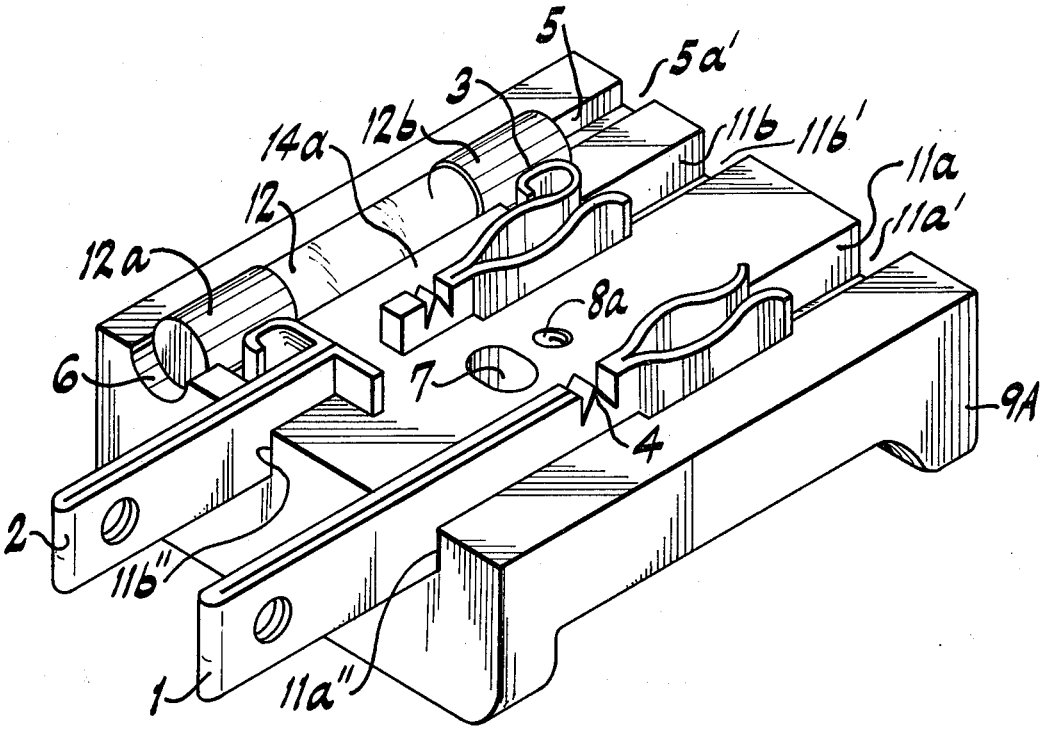
FIG. 1 illustrates a side perspective view and bottom view of half of a housing structure of the invention, with the male and female elements mounted therein in their respective proper places and channel spaces, also showing the typical electrical fuse within its proper third channel space.

With particular reference first to FIG. 1, there is shown shell 9A which is half of the housing structure. Parts thereof, and the mounted elements are as follow. Male element or prong 1 is continuous with the opposite-end female element located within the first channel. The male prong or element 1 extends from bottom opening 11*a*″, and the female element mounted in the first channel is located in channel space 11*a* adjacent upper opening 11*a*′. Likewise, the male element 2 extends from opening 11*b*″ of the space of the second channel, and the female element corresponding thereto but separate (not continuous) is located in upper space 11*b* adjacent upper opening 11*b*′, having the flange 3 thereof extending into the space of the third channel. Likewise the male element of channel two (second channel) has its flange also extending into the lower space of the third channel. The male and female flanges make contact respectively with the lower fuse contact 12*a* and upper fuse contact 12*b* of the electrical fuse 12. The communicating-space between the second and third channels is typically identified, for the upper portion of the housing structure, as space 14*a*. The fuse 12 is insertable and removable from the third channel through the insertion hole 6 at the bottom end and face of the housing structure. At an opposite upper end, there is a small opening 5*a*′ through which a small object or element may be inserted to push-against the upper end of the electrical fuse to thereby shove it outwardly through the insert opening 6, in a removal process.

The through-hole 7 is of a size to receive therethrough insertion wires (leads), one of which is placed over one serated edge 4, an the other one placed over the opposite (channel two) other serated edge of the female contacts, such that when the other shell 9B of FIG. 5 is mounted on the shell 9A, the wires make electrical contact with the female elements respectively. Thereupon, the screw 15 is screwed into the female-threaded receptacle 8*b*.

In FIG. 5, the slot 13 accomodates the wires inserted through the through-hole 7, when the shell 9B is mounted on the shell 9A.

Figure 2:
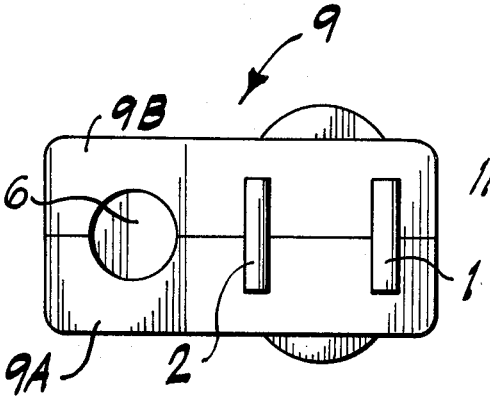
FIG. 2 illustrates a bottom view of the entire fuse and entire housing thereof, of the FIG. 1 embodiment.

FIG. 2 shows the prong-end face.

Figure 3:
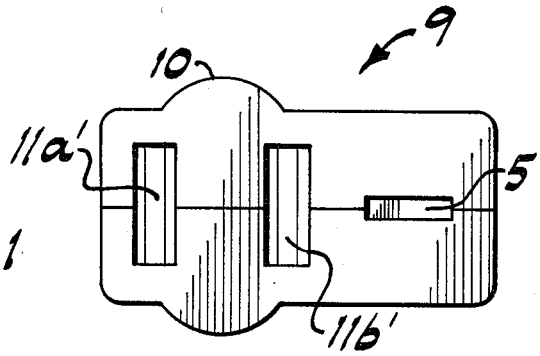
FIG. 3 illustrates a top view of the entire fuse and entire housing thereof, of the FIG. 1 embodiment.

FIG. 3 shows the female-receptacle face.

Figure 4:
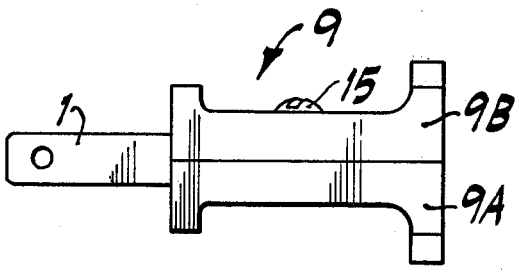
FIG. 4 illustrates a side view of the entire fuse and entire housing thereof, of the FIG. 1 embodiment.

FIG. 4 shows a side view illustrating a preferred shape of the outer surface of the housing, and overall shape of the adapter itself as a whole.

FIG. 5 additionally shows the typical corresponding cummunication-space by which the second and third channels have communicating spaces through which the flanges of the electrical elements extend, as shown in FIG. 1.

FIG. 6 illustrates the plug-adapter 9 having the through-hole 7 and the wiring 15′ and the lights 16, previously discussed.

It is within the scope of the invention to make such variations and modifications and substitution of equivalents as would be apparent to a person of ordinary skill.

I claim:

1. An electrical fuse-plug adapter and circuit comprising in combination, a non-conductor housing having formed therein three separate through-channels having first, second and third channel-openings, and first, second and third other-channel-openings, and interconnecting channel spaces thereof, said first and second other-channel-openings being female receptacles positioned to receive paired male prongs of an electrical plug, said first and second channel-openings each being of a size and shape and including first channel-support-structure adapted to mount and support paired male electrical conductor elements with one within each respectively of the first and second through-channels adjacent said channel-openings, and said first and second through-channels each being of a size and shape and including second channel-support-structure adapted for each to mount and support a female electrical conductor element adjacent said first and second other-channel-openings at locations such that electrical contact is made with said paired male prongs when said electrical plug is mounted within the first and second other-channel-openings, said third other-channel-opening being of a size and shape adapted to receive an element therethrough into said third channel such that an electrical fuse mounted within the third through-channel may be pushed out of said third channel-opening, first and second male and female electrical conductors, the first and second female electrical conductors being mounted and supported respectively in said first and second through-channels paired-with and adjacent said first and second other-channel-openings, the first and second male electrical conductors mounted and supported respectively in said first and second through-channels and extending outwardly from respectively said first and second channel-openings, said housing structure being constructed with said second and third channels being in communication with one-another such that an upper electrical-contact end of an electrical fuse contacts said second male electrical conductor and concurrently a lower electrical-contact end of the electrical fuse contacts said second female electrical conductor when the electrical fuse is mounted within said third through-channel, said second female electrical conductor being separate and spaced from said second male electrical conductor, said housing structure including a cord-receiving hole in a face thereof with the hole being in communication with each of said first and second through-channels by cross-channels formed within inner walls of said housing structure adapted for parted-paired lead-wires to operatively make electrical contact with one of the paired wires in contact with said first female electrical conductor and a remaining other one of the paired wires in contact with said second female electrical conductor, and first and second electrical cord leads positioned within said hole and within said cross-channels and having the first electrical cord positioned in electrical communication with at least said first female electrical conductor and having the second electrical cord lead in electrical communication with said second female electrical conductor.

2. An electrical fuse-plug adapter and circuit of claim 1, including Christmas-tree lights-sockets operatively mounted onto said electrical cord leads.

3. An electrical fuse-plug adapter and circuit of claim 1, in which at least one of the male and female electrical conductors of each of the first and second electrical conductors, includes a lead-contacting biting edge adapted to cut-through electrical wire insulation and thereby make-contact respectively with said first and second electrical cord leads mounted within said cross-channels when pressed thereagainst by a clamping structure, and housing clamping structure positioned and adapted to clamp said first and second electrical cord leads into electricity-conducting contact with said biting edges.

4. An electrical fuse-plug adapter and circuit of claim 3, in which said housing clamping structure comprises a detachable portion of said non-conductor housing structure.

5. An electrical fuse-plug adapter and circuit of claim 1, in which each of said second male and female electrical conductors include a spring-biasing portion extending into channel-space of said third through-channel, positioned to press an inserted electrical fuse retainably against an opposite portion of said inner walls, and said spring-biasing portion simultaneously serving to improve electrical contact with an inserted electrical fuse.

6. An electrical fuse-plug adapter and circuit of claim 5, including Christmas-tree lights-sockets operatively mounted onto said electrical cord leads.

7. An electrical fuse-plug adapter and circuit of claim 6, in which at least one of the male and female electrical conductors of each of the first and second electrical conductors, includes a lead-contacting biting edge adapted to cut-through electrical wire insulation and thereby make-contact respectively with said first and second electrical cord leads mounted within said cross-channels when pressed thereagainst by a clamping structure, and housing clamping structure positioned and adapted to clamp said first and second electrical cord leads into electricity-conducting contact with said biting edges.

8. An electrical fuse-plug adapter and circuit comprising in combination, a non-conductor housing having formed therein three separate through-channels having first, second and third channel-openings, and first, second and third other-channel-openings, and interconnecting channel spaces thereof, said first and second other-channel-openings being female receptacles positioned to receive paired male prongs of an electrical plug, said first and second channel-openings each being of a size and shape and including first channel-support-structure adapted to mount and support paired male electrical conductor elements with one within each respectively of the first and second through-channels adjacent said channel-openings, and said first and second through-channels each being of a size and shape and including second channel-support-structure adapted for each to mount and support a female electrical conductor element adjacent said first and second other-channel-openings at locations such that electrical contact is made with said paired male prongs when said electrical plug is mounted within the first and second other-channel-openings, said third other-channel-opening being of a size and shape adapted to receive an element therethrough into said third channel such that an electrical fuse mounted within the third through-channel may be pushed out of said third channel-opening, first and second male and female electrical conductors, the first and second female electrical conductors being mounted and supported respectively in said first and second through-channels paired-with and adjacent said first and second other-channel-openings, the first and second male electrical conductors mounted and supported respectively in said first and second through-channels and extending outwardly from respectively said first and second channel-openings, said housing structure being constructed with said second and third channels being in communication with one-another such that an upper electrical-contact end of an electrical fuse contacts said second male electrical conductor and concurrently a lower electrical-contact end of the electrical fuse contacts said second female electrical conductor when the electrical fuse is mounted within said third through-channel, said second female electrical conductor being separate and spaced from said second male electrical conductor, said housing structure including a cord-receiving hole in communication with each of said first and second through-channels, at least one of said first male and female electrical conductors and at least one of said second male and female electrical conductors including an electrical-lead biting edge adapted to cut-through electrical insulation and thereby make-contact reapectively with separate ones of paired electrical leads mountable through said cord-receiving hole when pressed thereagainst by a clamping structure, and said non-conductor housing including housing clamping structure positioned and adapted to clamp paired electrical leads mounted through said cord-receiving hole into electricity-conducting contact with said electrical-lead biting edges.

* * * * *